United States Patent [19]

Spaulding et al.

[11] 4,156,267

[45] May 22, 1979

[54] GAS IONIZING

[75] Inventors: Charles B. Spaulding, Nashua; Vernon Goffin, Amherst; Francis A. Brady, Hollis; George M. J. Selley, Merrimack, all of N.H.

[73] Assignee: Vanguard Energy Systems, Boston, Mass.

[21] Appl. No.: 883,830

[22] Filed: Mar. 6, 1978

[51] Int. Cl.[2] ..... H01T 19/00

[52] U.S. Cl. ..... 361/230; 361/229; 361/231

[58] Field of Search ..... 361/225, 226, 229, 230, 361/231; 123/119 E

[56] References Cited

U.S. PATENT DOCUMENTS

| | | | |
|---|---|---|---|
| 1,405,613 | 2/1922 | Milliken | 361/229 X |
| 2,998,308 | 8/1961 | Ruth | 361/230 X |
| 3,742,301 | 6/1973 | Burris | 361/230 |

*Primary Examiner*—Harry E. Moose, Jr.
*Attorney, Agent, or Firm*—Charles Hieken

[57] ABSTRACT

Conducting plates of opposite electrical potential are alternately disposed and spaced apart and immersed in a dielectric fluid in a chamber. Gas is supplied to the bottom of the chamber and passes through the fluid and over the plates. A partial vacuum is maintained in the region above the surface of the dielectric, from which the gas is extracted.

13 Claims, 2 Drawing Figures

GAS IONIZING

BACKGROUND OF THE INVENTION

The present invention relates generally to the ionization of gases and more particularly to the ionization of air to produce gas having a negative charge.

It is known that the ionization of the air, or fuel, or both, supplied to a fuel combustion chamber greatly improves the efficiency of the combustion process, making the combustion more complete, reducing the buildup of undesirable material in the combustion chamber and its exhaust system, and decreasing the amount of pollutants emitted by the combustion device.

One way of improving the combustion process in an already existing device is to supply ionized air to the air intake of the device's combustion chamber.

Accordingly, it is an object of this invention to provide an improved apparatus for ionizing air for fuel combustion chambers.

It is another object of the invention to provide a simple, efficient apparatus for the production of ionized gas, including ionized air.

SUMMARY OF THE INVENTION

According to the invention, there is a chamber that may hold dielectric fluid; in the chamber, overlapping, spaced apart conductive plates connectable to sources of different electrical potential, the plates being disposed so that they may be immersed in the fluid. There are means for supplying gas to, and extracting it from the chamber, in a way that will cause the gas to pass over the immersed plates.

According to other features of the invention, means are provided for creating a partial vacuum in the region of the chamber not containing the fluid, and means are included for supplying gas to the chamber in the region containing the fluid, at a region remote from the surface of the fluid. One set of plates may be connected to one terminal and a second set to a second terminal, the plates of the different sets alternating. The plates, according to another feature of the invention comprise aluminum negative plates curved at the top away from respective closely spaced positive copper plates, and disposed at an angle from an axis passing substantially through the centers of the plates, the angle being substantially 45°.

Numerous other features, objects and advantages of the invention will become apparent from the following specification when read in connection with the accompanying drawing in which:

DETAILED DESCRIPTION OF PREFERRED EMBODIMENTS

Figure 1:
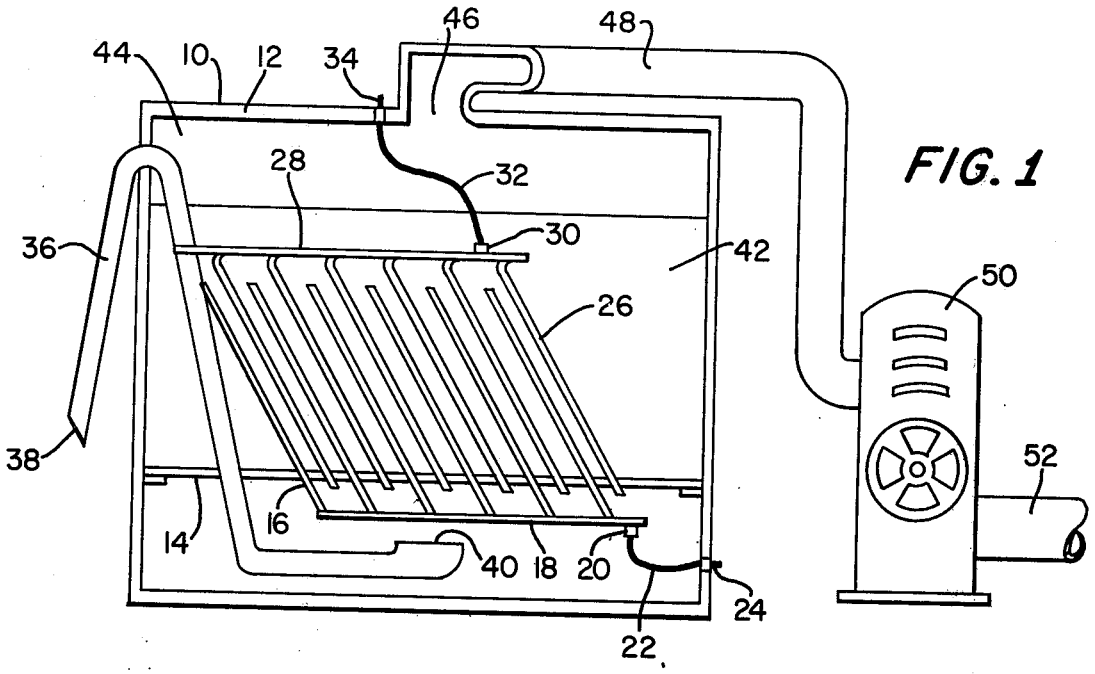
FIG. 1 is a pictorial representation of a preferred embodiment of the invention.
Figure 2:
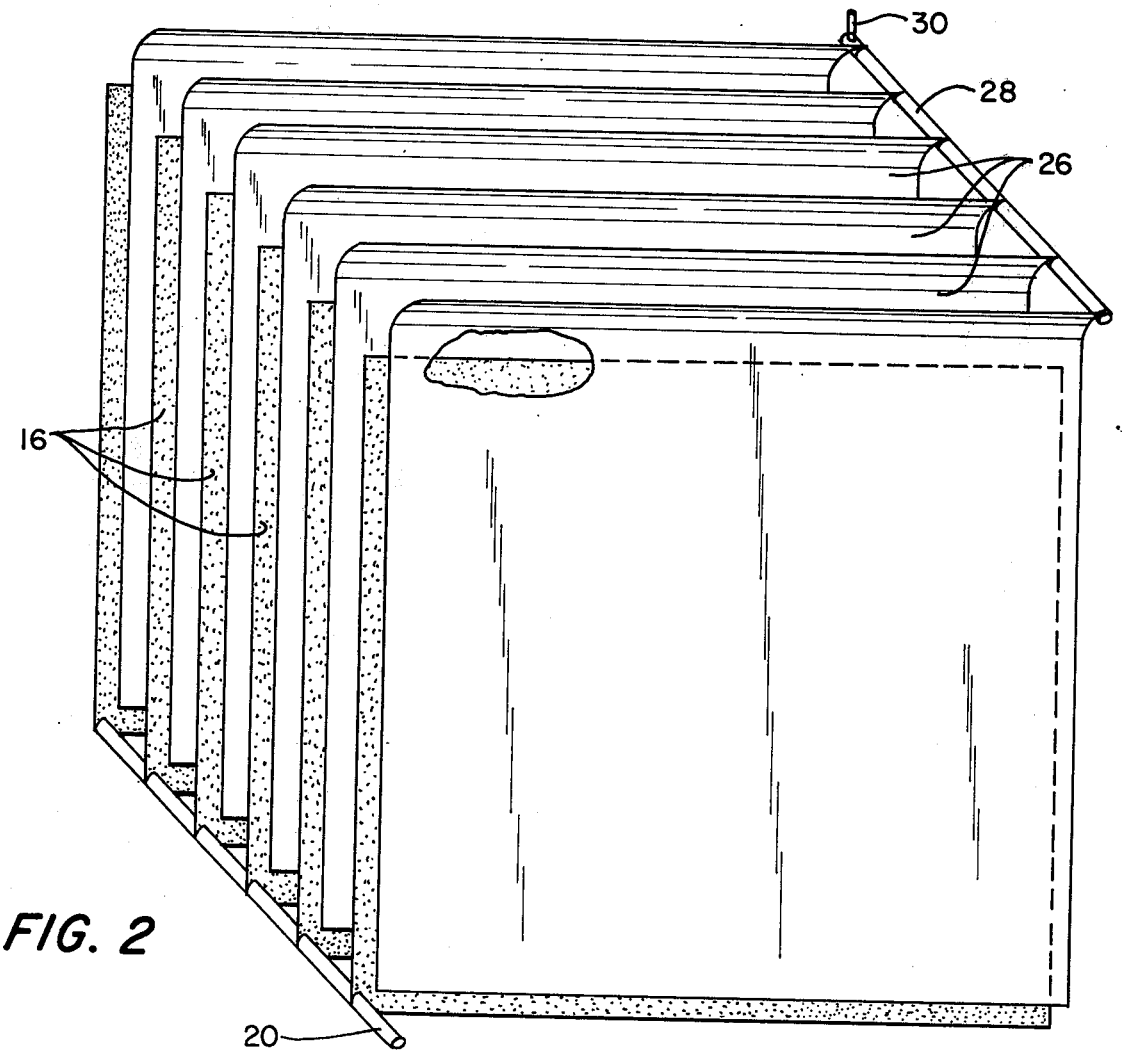
FIG. 2 is a perspective view of the plates forming part of the preferred embodiment apparatus.

Referring to FIG. 1, there is shown a pictorial representation of a preferred embodiment of the invention having a chamber 10, substantially air tight, with a chamber wall 12. Mounted inside chamber 10 is a plastic base 14 supporting a set of positive copper plates 16 and negative grounded aluminum plates 26 several inches long. Each copper plate 16 is connected to a copper bus 18 with a terminal 20 connected via cable 22 to a terminal 24 on the exterior of the chamber wall 12. Aluminum plates 26 are connected to an aluminum bus 28 with a terminal 30 connected via cable 32 to another terminal 34 on the exterior of chamber wall 12.

The copper and aluminum plates 16 and 26 dovetail with a one-half inch distance between each pair of plates in this specific embodiment where the voltage between copper and aluminum plates immersed in high tension transformer oil dielectric fluid 42 is 8000 v. D.C. Generally, the plate spacing, polarizing potential and dielectric material are selected to establish an intense electric field without arcing. Furthermore, the copper and aluminum plates 16, 26 are so disposed that they are about at an angle of 45° from a line, or axis, passing substantially through the centers of all the plates.

An air supply tube 36 made of aluminum, with an intake port 38 passes through chamber wall 12 into the chamber 10, terminating in an outlet port 40 below the copper and aluminum plates 16 and 26.

A dielectric fluid 42 fills most of the chamber 10, immersing the copper and aluminum plates 16 and 26. A region 44 of the chamber 10 is not filled with liquid 42.

In the upper part of the chamber wall 12 in the region 44 free of liquid 42, an intake port 46 for a gas extracting tube 48 is formed. The gas extracting tube 48 is connected to a vacuum pump 50. The vacuum pump 50, in turn, has a supply tube 52. Internal surfaces of all parts across which gas exits from the surface of fluid 42 is preferably insulated with high dielectric membrane.

In operation, vacuum pump 50 creates a partial vacuum in chamber region 44 above dielectric fluid 42. An agitated stream of air, supplied to the bottom of chamber 10 by air supply tube 36 through port 40, remote from the surface of the dielectric fluid 42, passes through the fluid, and over and between copper and aluminum plates 16 and 26. The terminals 24 and 24 on the outside of the chamber wall, to which the sets of copper and aluminum plates are respectively connected, are connected to a voltage source so that a high voltage difference, typically about 8000 volts, is supplied via the terminals to the plates.

Consequently, the air passing through gas extracting tube 48 as a result of the effect of vacuum pump 50 is ionized. The supply tube 52 of the vacuum pump 50 therefore has a supply of ionized air that may be supplied to the combustion chamber of whatever device is desired to enhance the combustion process. The device may be anything from an industrial oil furnace to the internal combustion engine of an automobile.

There has been described novel apparatus and techniques for ionizing gas that is relatively simple and efficient. It is evident that those skilled in the art may now make numerous uses and modifications of and departures from the specific embodiment described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A gas ionizing apparatus comprising, a chamber adapted to hold dielectric fluid, overlapping, spaced apart plates of conductive material disposed within said chamber so that upon the addition of dielectric fluid to said chamber said plates would be immersed in said fluid, alternate said plates being connectable to sources of different electrical potential, means for supplying a gas to said chamber and means for extracting a gas from said chamber, said means being disposed so that said gas passes over said plates.

2. The apparatus of claim 1 in which said means for extracting a gas from said chamber includes means for creating a partial vacuum in the region of said chamber not containing said fluid.

3. The apparatus of claim 1 in which said means for supplying a gas to said chamber includes means for supplying said gas to the region of said chamber containing said fluid.

4. The apparatus of claim 2 in which said means for supplying a gas to said chamber includes means for supplying said gas to a region of said chamber containing said fluid and remote from said region not containing said fluid.

5. The apparatus of claim 1 in which a first set of said plates are connected to a first terminal and a second set of said plates are connected to a second terminal, the plates of said first and second sets alternating in their disposition in said chamber.

6. The apparatus of claim 5 in which respective pairs of said plates define gas passages therebetween in a high electric field.

7. The apparatus of claim 6 in which said plates are disposed at an angle to an axis passing substantially through the centers of said plates.

8. The apparatus of claim 7 in which said angle is substantially 45°.

9. A gas ionizing apparatus comprising, a chamber adapted to hold dielectric fluid, overlapping, equally spaced apart plates of conductive material disposed within said chamber so that upon the addition of said fluid to said chamber said plates would be immersed in said fluid, a first set of said plates being connected to a first terminal and a second set of said plates being connected to a second terminal, the plates of said first and second sets alternating in their disposition in said chamber, means for extracting gas from said chamber including means for creating a partial vacuum in the region of said chamber not containing said fluid when said plates are immersed in said fluid, means for supplying gas to said chamber, including means for supplying said gas to the region of said chamber containing said fluid when said plates are immersed in said fluid, said means for extracting gas and said means for supplying gas to said chamber being disposed so that said gas passes over said plates.

10. A method for ionizing gas comprising, partially filling a chamber with dielectric fluid, immersing in said fluid overlapping, spaced apart plates of conductive material, connecting alternate sets of said plates to different electric potentials, supplying gas to a region of the fluid remote from its surface, and creating a partial vacuum in the region of the chamber not filled with said fluid.

11. Gas ionizing apparatus in accordance with claim 1 wherein a first set of said plates is made of aluminum for connection to the negative terminal of a D. C. potential source and a second set of said plates dovetailed with said first set is made of copper for connection to the positive terminal of said potential source for establishing an intense electric field between a copper plate and at least one adjacent aluminum plate, and dielectric fluid covering said plates.

12. Gas ionizing apparatus in accordance with claim 1 wherein said plates form an angle with the vertical and a set of said plates is formed with the plate top curving upward the vertical.

13. Gas ionizing apparatus in accordance with claim 12 further comprising dielectric fluid covering said plates.

* * * * *